US005522739A

United States Patent [19]

Axelsson

[11] Patent Number: 5,522,739

[45] Date of Patent: Jun. 4, 1996

[54] INSULATED TERMINAL WITH INTEGRAL DUAL FLARED BARREL

[75] Inventor: Lennart C. Axelsson, Tinley Park, Ill.

[73] Assignee: Panduit Corp., Tinley Park, Ill.

[21] Appl. No.: 227,940

[22] Filed: Apr. 15, 1994

[51] Int. Cl.[6] ..... H01R 4/18

[52] U.S. Cl. ..... 439/730; 439/877

[58] Field of Search ..... 439/730, 877, 439/879, 881, 882, 932

[56] References Cited

U.S. PATENT DOCUMENTS

| | | | |
|---|---|---|---|
| 2,671,889 | 3/1954 | Vickery . | |
| 2,681,440 | 6/1954 | Swengel . | |
| 2,749,529 | 6/1956 | Curtiss | 439/730 |
| 2,769,965 | 11/1956 | Frey . | |
| 2,774,810 | 12/1956 | Ritter | 439/730 X |
| 2,806,214 | 9/1957 | Forney, Jr. . | |
| 2,807,792 | 9/1957 | O'Keefe et al. . | |
| 2,863,132 | 12/1958 | Sowa . | |
| 3,098,688 | 7/1963 | Crimmins et al. . | |
| 3,291,894 | 12/1966 | Sampson | 439/730 X |
| 3,356,987 | 12/1967 | Gillespie . | |
| 3,390,370 | 6/1968 | Golankiewicz . | |
| 3,521,224 | 7/1970 | Spooren . | |
| 3,594,713 | 7/1971 | Thoman . | |
| 3,601,783 | 8/1971 | Loose | 439/730 |
| 3,605,077 | 9/1971 | Kaylor . | |
| 3,634,817 | 1/1972 | Wise . | |
| 3,673,549 | 6/1972 | Bliley . | |
| 3,675,188 | 7/1972 | Startin et al. . | |
| 3,734,992 | 5/1973 | Masino et al. . | |
| 3,774,141 | 11/1973 | Condon | 436/730 |
| 4,012,106 | 3/1977 | Filson | 439/730 X |
| 4,298,243 | 11/1981 | Swengel, Jr. et al. | 439/730 |
| 4,813,893 | 3/1989 | Sindlinger | 439/730 |
| 5,118,313 | 6/1992 | Delalle | 439/730 |

FOREIGN PATENT DOCUMENTS

| | | |
|---|---|---|
| 0665741 | 5/1988 | Japan . |

*Primary Examiner*—Khiem Nguyen
*Attorney, Agent, or Firm*—Mark D. Hilliard; Robert A. McCann

[57] ABSTRACT

A fully or partially insulated electrical terminal connector for making a terminal connection to a stripped end of a wire including a dual flared wire crimp barrel and an improved funnel wire entry end.

12 Claims, 4 Drawing Sheets

INSULATED TERMINAL WITH INTEGRAL DUAL FLARED BARREL

TECHNICAL FIELD

The present invention relates to electrical terminal connectors, and more particularly to insulated electrical terminal connectors of the type that are crimped to a stripped end of an electrical conductor.

BACKGROUND OF THE INVENTION

Insulated electrical terminal connectors having a terminal end attached to a crimping end for terminating the stripped ends of electrical conductors are well known in the art. Examples include U.S. Pat. Nos. 5,118,313 to Dellale; 4,813,893 to Sindlinger; 3,601,783 to Loose and 3,098,688 to Crimmins et al. These terminal connectors may be found having a variety of terminal ends such as ring, fork, pin or flat male tab receptacles. Several desireable features of terminals of this type include ease of insertion of the stripped wire end into the crimping end, simple and effective crimping that provides strain relief by crimping both the insulated portion and stripped end of the wire, simplicity of manufacture, and secure seating of the terminal within the insulative housing.

In order to achieve strain relief crimping it is necessary to crimp both the stripped end of the wire for the electrical connection and also crimp an insulated portion of the wire for strain relief. A larger diameter crimp barrel is needed for the insulated portion. However, if the entire crimp barrel is made at this larger diameter ineffective crimping becomes more likely. Additionally, a smaller diameter crimp barrel for the stripped end of the wire helps to direct and center the wire. Some of the prior terminals have used multi-part crimping means such as smaller inner sleeves which are more complicated to use and manufacture.

Similarly, prior art insulated terminal connectors have employed multi-part terminal connectors and other more complicated means for securely seating the terminal within the housing. These prior art attempts included folding or bending operations as well as methods of chemical bonding. However, use of chemicals is undesirable and none of the other prior art insulated terminals have achieved all of the above features. Therefore, improvements in the art are still desired and are achieved by the present invention.

SUMMARY OF THE INVENTION

It is therefore an object of the present invention to provide an improved electrical terminal connector.

It is further an object of the present invention to provide an insulated electrical terminal connector having an improved wire entry end.

It is another object of the present invention to provide an insulated electrical terminal connector that is more securely seated within its insulated housing.

Other objects and advantages of the present invention will become apparent from the following detailed description.

DESCRIPTION OF THE PREFERRED EMBODIMENT

Figure 1:
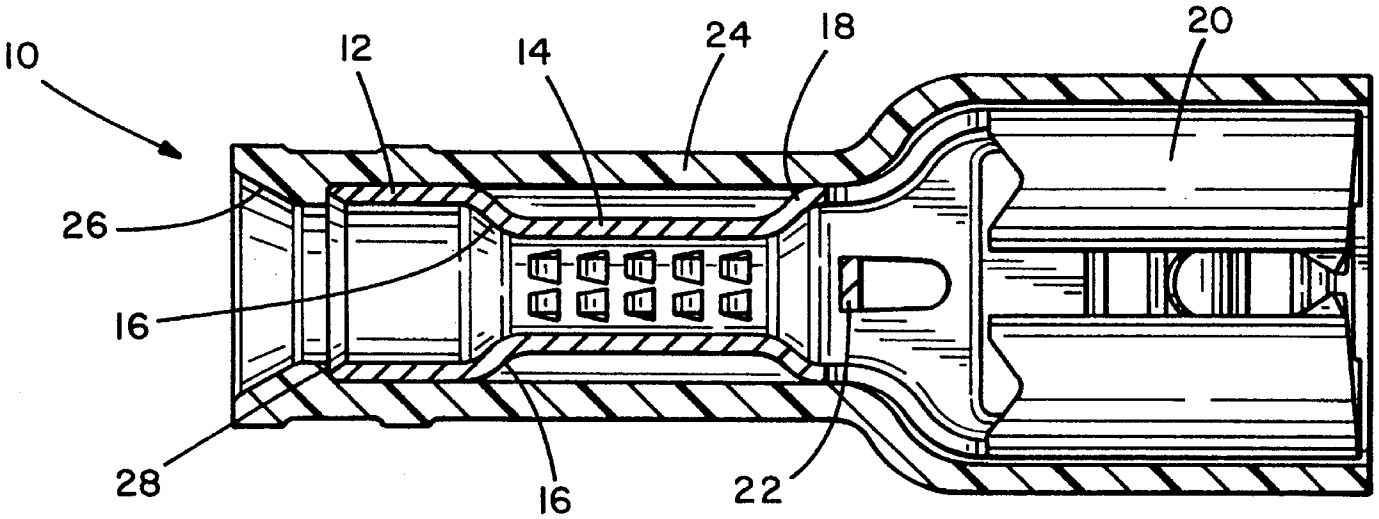
FIG. 1 is a top cross-sectional view of a fully insulated electrical terminal connector embodying the concept of the present invention.
Figure 2:
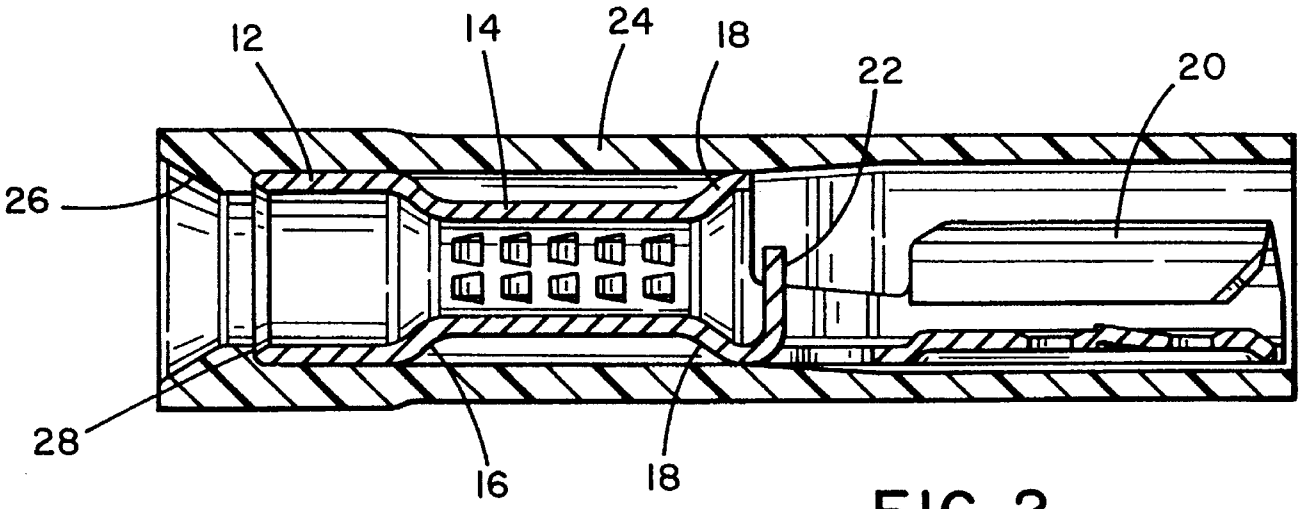
FIG. 2 is a side cross-sectional view of the fully insulated electrical terminal connector of FIG. 1.
Figure 3:
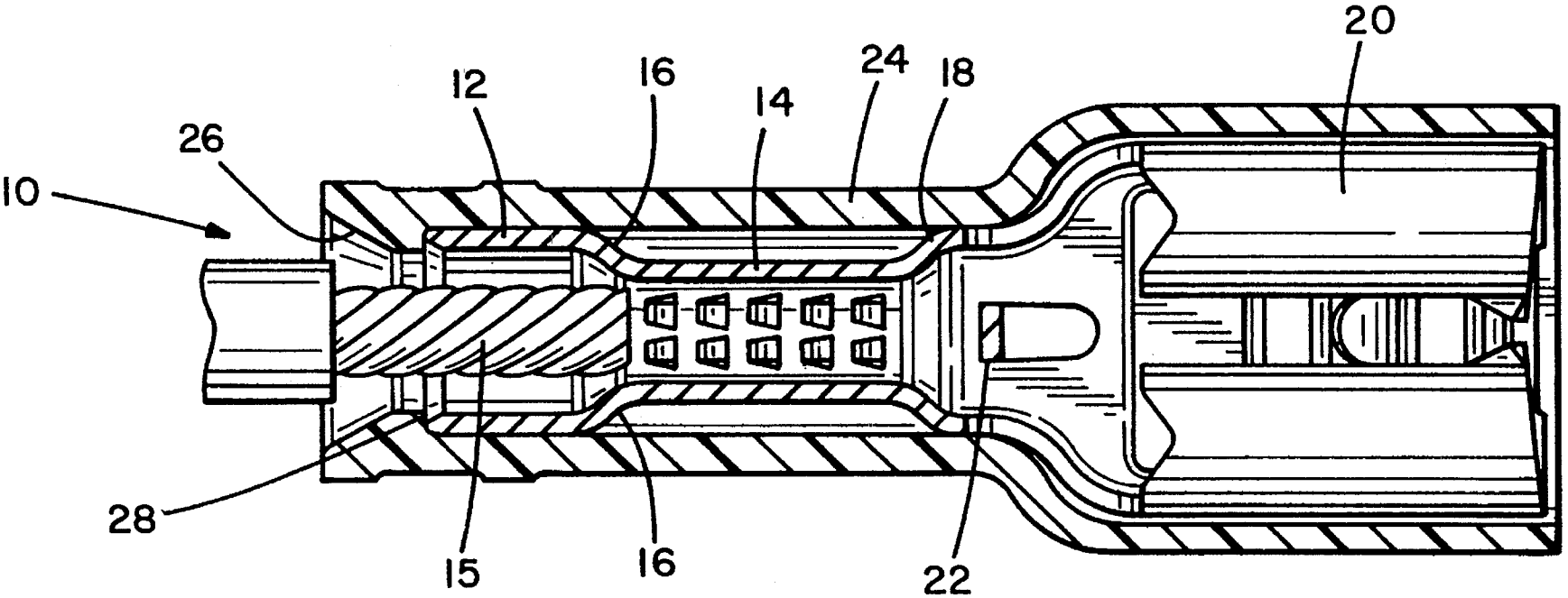
FIG. 3 is a top cross-sectional view of a fully insulated electrical terminal connector of FIG. 1 shown with a stripped wire partially inserted.

The fully insulated electrical terminal of the present invention is designated generally by the reference numeral 10 in FIGS. 1–3. The electrical terminal is formed from a plated or unplated brass strip by a stamping process. The terminal includes a wire crimping portion 12 and a terminal portion 20. Wire crimping portion 12 is formed having a cylindrical crimping barrel 14 with a flared wire entry end 16 and a flared terminal end 18. An insulated housing sleeve 24 formed from thermoplastic material is provided to partially or fully cover the metal terminal. Terminal portion 20 is integrally connected to and extending from the wire crimping portion at the terminal end 18. The electrical terminal is inserted into a front end of an insulative housing sleeve 24 until further movement is prevented by stops 28 formed on the interior of the rear end of housing sleeve 24. The bell-mouth shaped flared entry end 16 and terminal end 18 of crimping barrel 14 create a pressfit with the insulative housing sleeve 24 that securely seats the electrical terminal within the housing sleeve 24 to prevent unwanted movement or slippage of the terminal connector. This improved seating is provided while maintaining a smaller diameter crimp barrel 14 for enhancing the electrical connection with the stripped end of the electrical wire 15 to be terminated.

The funnel entry end 26 of the insulative housing 24 forms a funnel-shaped ramp that inclines into the housing 24 until reaching the stops 28. Stops 28 are formed around the interior of housing sleeve 24 so as to have a depth substantially equal to the thickness of the wall of crimp barrel 14 leading into the funnel entry end 16 to provide an unimpeded path for the stripped end of wire 15 to be inserted. The smaller diameter of crimp barrel 14 also directs and centers the stripped end of the wire 15 so that upon insertion stripped end 15 more readily abuts with a wire stop 22 formed on terminal portion 20. Additionally, the flared entry end 16 of crimp barrel 14 creates a larger diameter neck section which allows for crimping of an insulated portion of wire 15 to provide the desired strain relief crimping.

Figure 4:
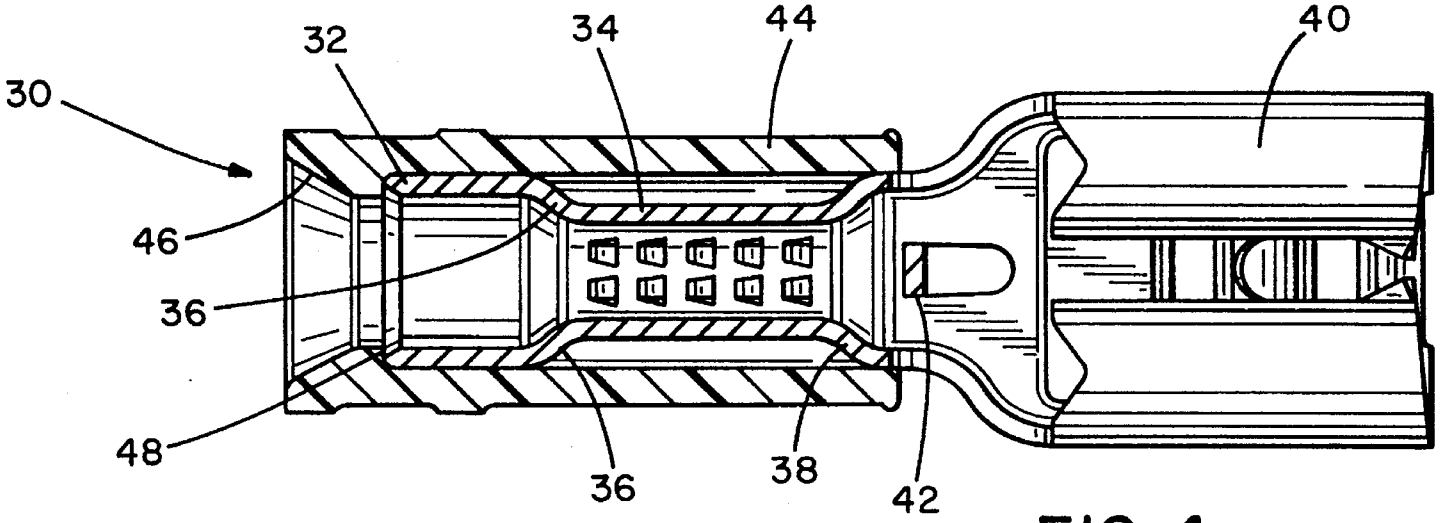
FIG. 4 is a top cross-sectional view of a partially insulated electrical terminal connector embodying the concept of the present invention.
Figure 5:
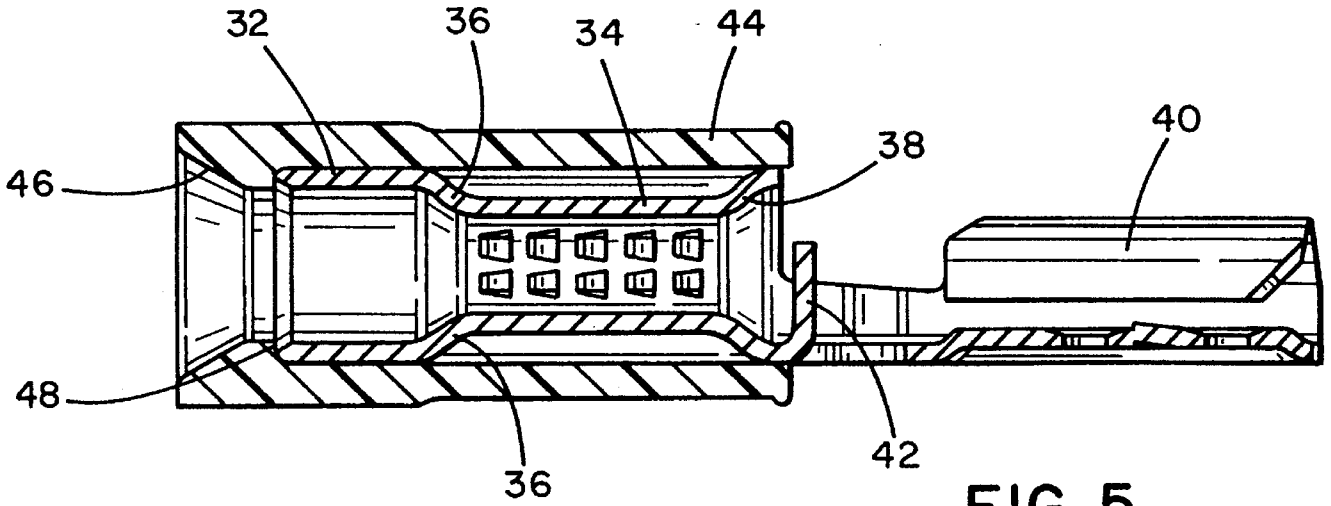
FIG. 5 is a side cross-sectional view of the partially insulated electrical terminal connector of FIG. 4.

FIGS. 4–5 show a partially insulated embodiment of a terminal 30 in accordance with the present invention. This terminal includes the funnel entry ramp 46 of insulated housing sleeve 44 leading into the crimp barrel portion 32 to create an unimpeded wire entry end for a stripped end of a wire. The housing sleeve 44 covers the entire crimp barrel portion 32 extending past both the flared wire entry end 36 and the flared terminal end 38. This allows for the flared ends to press fit within housing 44 to create a more secure seating of the terminal within the housing sleeve 44.

Figure 6:
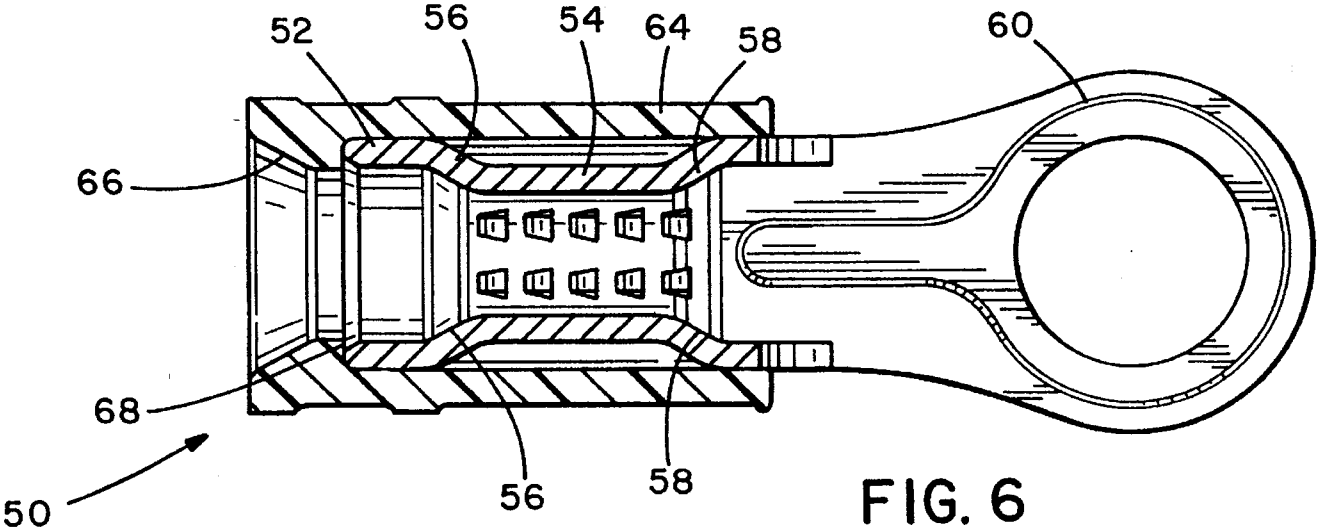
FIG. 6 is a top cross-sectional view of a partially insulated ring type electrical terminal connector embodying the concept of the present invention.
Figure 7:
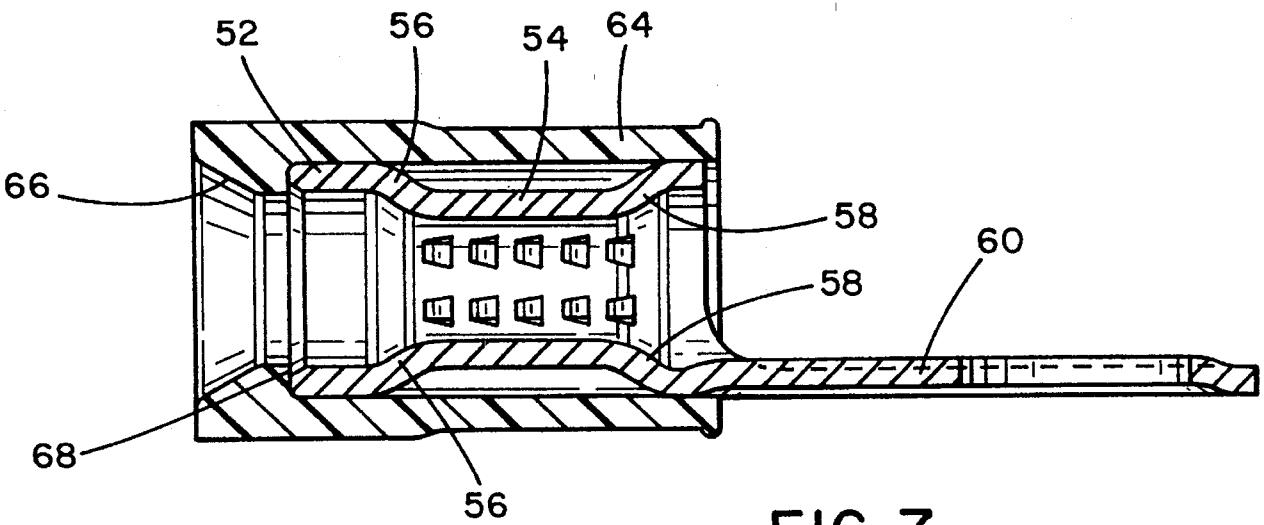
FIG. 7 is a side cross-sectional view of the partially insulated ring type electrical terminal connector of FIG. 6.

FIGS. 6–7 shows a third embodiment of a partially insulated terminal 50 in accordance with the present invention. This terminal is a ring type terminal and also includes the funnel entry ramp 66 of insulated housing sleeve 64 leading into the crimp barrel portion 52 to create an unimpeded wire entry end for a stripped end of a wire. The housing sleeve 64 covers the entire crimp barrel portion 52 extending past both the flared wire entry end 56 and the flared terminal end 58. This similarly allows for a more secure seating of the terminal within the housing sleeve 64.

While the particular embodiments of the present invention have been shown and described, it will be obvious to those skilled in this art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An insulated electrical terminal connector adapted to be crimped to a stripped end of an electrical conductor comprising:

a unitary wire crimping portion formed by a generally cylindrical wall of substantially uniform thickness as a crimping barrel portion of uniform diameter and a flared wire entry end of increasing diameter and a flared terminal joining end of increasing diameter, prior to being crimped to said stripped end of the electrical conductor;

a terminal portion integrally connected to the terminal joining end of the crimping barrel; and, an insulative housing sleeve covering at least the wire crimping portion.

2. An electrical terminal connector according to claim 1, wherein the flared entry end and the flared terminal joining end of wire crimping barrel are bell-mouth shaped.

3. An electrical terminal according to claim 2, wherein the housing sleeve includes a funnel entry ramp formed so as to lead into the wire entry end of the crimping barrel.

4. An electrical terminal according to claim 3, wherein the terminal portion is formed as a receptacle end adapted to receive a flat male tab.

5. An electrical terminal according to claim 4, wherein the insulative housing sleeve extends from the wire entry end of the crimping portion over the entire terminal portion so as to cover the electrical terminal.

6. An electrical terminal according to claim 3, wherein the terminal portion is formed as a ring type terminal.

7. An electrical terminal for mating with a flat male terminal comprising:

a wire crimping portion formed as a crimping barrel portion of a uniform diameter and having a flared wire entry end of increasing diameter and a flared terminal joining end of increasing diameter, prior to being crimped to a stripped end of an electrical conductor;

a terminal portion integrally connected to the terminal joining end of the crimping barrel; and an insulative housing sleeve covering at least the wire crimping portion and including a funnel entry ramp formed so as to incline into the housing until reaching an interior stop.

8. An electrical terminal according to claim 7, wherein the stop is formed having a depth substantially equal to the thickness of a wall of the crimp barrel.

9. An electrical terminal according to claim 8, wherein the terminal joining end is flared.

10. An electrical terminal according to claim 9, wherein the flared entry portion and flared terminal joining end are bell-mouth shaped.

11. An electrical terminal according to claim 7, wherein the terminal portion is formed as a receptacle end adapted to receive a flat male tab.

12. An electrical terminal according to claim 7, wherein the terminal portion is formed as a ring type terminal.

* * * * *